US006102278A

United States Patent [19]

Rothas

[11] Patent Number: 6,102,278

[45] Date of Patent: Aug. 15, 2000

[54] FOLDABLE PAN

[76] Inventor: William J. Rothas, R.R. 4, Box 4065, Monticello, Fla. 32344

[21] Appl. No.: 09/294,228

[22] Filed: Apr. 19, 1999

[51] Int. Cl.[7] ..... B65D 5/46

[52] U.S. Cl. ..... 229/122; 15/257.1; 229/117.16; 229/195; 229/198; 294/55

[58] Field of Search ..... 229/117.13, 117.16, 229/122, 164, 195, 198; 15/104.8, 257.1, 257.4; 294/1.3, 55

[56] References Cited

U.S. PATENT DOCUMENTS

| | | | |
|---|---|---|---|
| D. 394,929 | 6/1998 | Ahumada | D34/1 |
| 2,453,973 | 11/1948 | Coats | 15/257.1 |
| 2,792,981 | 5/1957 | Grammer | 229/198 |
| 2,954,901 | 10/1960 | Winstead | 229/117.16 |
| 3,345,670 | 10/1967 | Charie | 15/257.1 |
| 3,439,861 | 4/1969 | Olson | 229/198 |
| 3,664,494 | 5/1972 | Mergens | 229/117.16 |
| 4,017,015 | 4/1977 | Jefferson | 294/55 |
| 4,391,223 | 7/1983 | Holland et al. | 229/195 |
| 4,434,829 | 3/1984 | Barnard | 150/44 |
| 4,558,980 | 12/1985 | Sturdivan | 412/2 |
| 4,635,843 | 1/1987 | Tomlinson | 294/55 |
| 4,809,390 | 3/1989 | Jackson et al. | 15/257.1 |
| 5,011,103 | 4/1991 | Hayes et al. | 248/99 |
| 5,020,185 | 6/1991 | Hoefler | 15/257.1 |
| 5,275,331 | 1/1994 | Chung-Piao | 229/117.15 |
| 5,366,077 | 11/1994 | Pham | 206/268 |
| 5,417,366 | 5/1995 | Hanko et al. | 229/227 |
| 5,449,083 | 9/1995 | Dougherty et al. | 220/9.1 |
| 5,473,790 | 12/1995 | Desarauis | 15/257.7 |
| 5,516,033 | 5/1996 | Bernetich | 229/92.7 |
| 5,570,862 | 11/1996 | Nugent | 248/97 |

*Primary Examiner*—Gary E. Elkins
*Attorney, Agent, or Firm*—Peter Loffler

[57] ABSTRACT

A foldable pan for receiving dirt and debris is initially formed as a relatively flat sheet member and thereafter folded into shape has a first body member and a second body member which are joined by a first side member that is foldably attached to each body member. A second side member foldably attaches to the first body member, while a third side member foldably attaches to the second body member. A first flap is connected to the first body member by a connection member that is foldably attached to each. A second flap and a third flap are each foldably attached to the connection means. The second body member is folded such that it is essentially parallel to the first body member with the first side member acting as a side wall of the pan. The second side member and the third side member are each folded up such that the second side member overlaps the third side member—these two side members acting as a second side wall of the pan. The first flap is folded up, via the connection member so that is overlaps the second body member—the connection member acting as the back wall of the pan. The second flap and the third flap are each folded so as to overlap the second and third side members, and the first side member respectively. Each of the flaps is attached to the member or members it overlaps in desired fashion.

20 Claims, 8 Drawing Sheets

FOLDABLE PAN

BACKGROUND OF THE INVENTION

1. Field of the Invention

The present invention relates to a pan that is initially constructed as a generally flat sheet member and thereafter folds, along various fold lines, to become a pan capable of receiving dirt and debris.

2. Background of the Prior Art

Collecting raked-up debris—such as leaves and grass—and depositing the debris into a trash can is a common chore. This relatively simple chore has spawned many devices to assist in the cleanup process. Such devices ranges from the elegant to the bizarre, and have many different designs based upon a multitude of theories of lawn debris cleanup. Some of the devices are effective while others are less so being either too expensive to manufacture or to difficult to use.

Therefore, there is a need in the art for a simple device that lets a user pickup common lawn and garden debris, as well as other debris, and efficiently transfer the debris to an appropriate disposal site. Such a device must be inexpensive to manufacture and must be quick and easy to use.

SUMMARY OF THE INVENTION

The foldable pan of the present invention addresses the aforementioned needs in the art. The foldable pan is a device that is manufactured as a single part and shipped in a relatively flat state thereby making the device relatively inexpensive. Once needed, the foldable pan is very quickly folded into shape—requiring less than ten simple folds to assemble—to create a pan that can receive and transfer debris. The foldable pan can be made from cardboard or heavy paper stock in order to further limit its costs of manufacture. As such, the foldable pan can is disposable after several uses. Alternately, the foldable pan can be made from more sturdy material such as sheet plastic.

The foldable pan of the present invention is comprised of a large unitary sheet member having a first body member that has a first length and a first width and a second body member that has a second length that is substantially similar to the first length the and a second width that is less the first width. The second body member is notched. A first side member is foldably attached to the first body member and is foldably attached to the second body member, while a second side member is foldably attached to the first body member, and a third side member is foldably attached to the second body member. A connection member is foldably attached to the first body member and is foldably attached to a first flap. A second flap is foldably attached to the connection member, and a third flap is also foldably attached to the connection member. In order to assemble the foldable pan, the second body member is folded, via the first side member, to be above and generally parallel with the first body member. The second side member is folded upwardly, and the third side member is folded downwardly such the second side member and the third side member overlap. The first flap member is folded, via the connection member, in order to overlap the second body member. The second flap member is folded to overlap the overlapping second and third side members and the third flap member is folded to overlap the first side member. The first flap member and the second body member are appropriately joined to each other, as are the second flap member and the overlapped second and third side members, and the third flap member and the first side member. Joining of the respective members can be accomplished in any appropriate fashion such as by stapling, gluing or taping the respective members to one another.

Alternately, an appropriate connection means can be provided on the foldable pan. The connection means can comprise at least one first string attached to the first flap and at least one first post attached to the second body member (or vice versa), at least one second string attached to the second flap and at least one second post attached to one of the second side member or the third side member (or vice versa), and least one third string attached to the third flap and at least one third post attached to the first side member (or vice versa). The respective string is tied around the respective post in order to provide effective joinder of the respective members. Alternately, the connection means can comprise at least one first tongue attached to the first flap and at least one first slit, each for receiving a respective one of the at least one first tongue, disposed on the second body member, at least one second tongue attached to the second flap at least one second slit, each for receiving a respective one of the at least one second tongue, disposed on the second side member and at least one corresponding third slit, each also for receiving a respective one of the at least one second tongue, disposed on the third side member, at least one third tongue attached to the third flap and at least one fourth slit, each for receiving a respective one of the at least one third tongue, disposed on the first side member, and at least one fourth tongue attached to the third side member and at least one slit, each for receiving a respective one of the at least one fourth tongue, disposed on the second side member (or vice versa). Each respective tongue is inserted into its corresponding slit or slits (in similar fashion to the closing of a cereal box top) in order to provide effective joinder of the respective members. As a further alternative, the connection means can comprise a first adhesive portion disposed on one of the first flap or the second body member, a second adhesive portion disposed on at least one of the second flap, the second side member or the third side member, and a third adhesive portion disposed on one of the third flap or the first side member. Perforated sections may be disposed on the foldable pan such that the user pushes in on the perforated sections in order to create a carrying point or handle for the foldable pan. Perforated sections can be located on each of the first side member, the second side member and the third side member. A perforated section can be located on the connection member, and a perforated section can be located on the second body member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
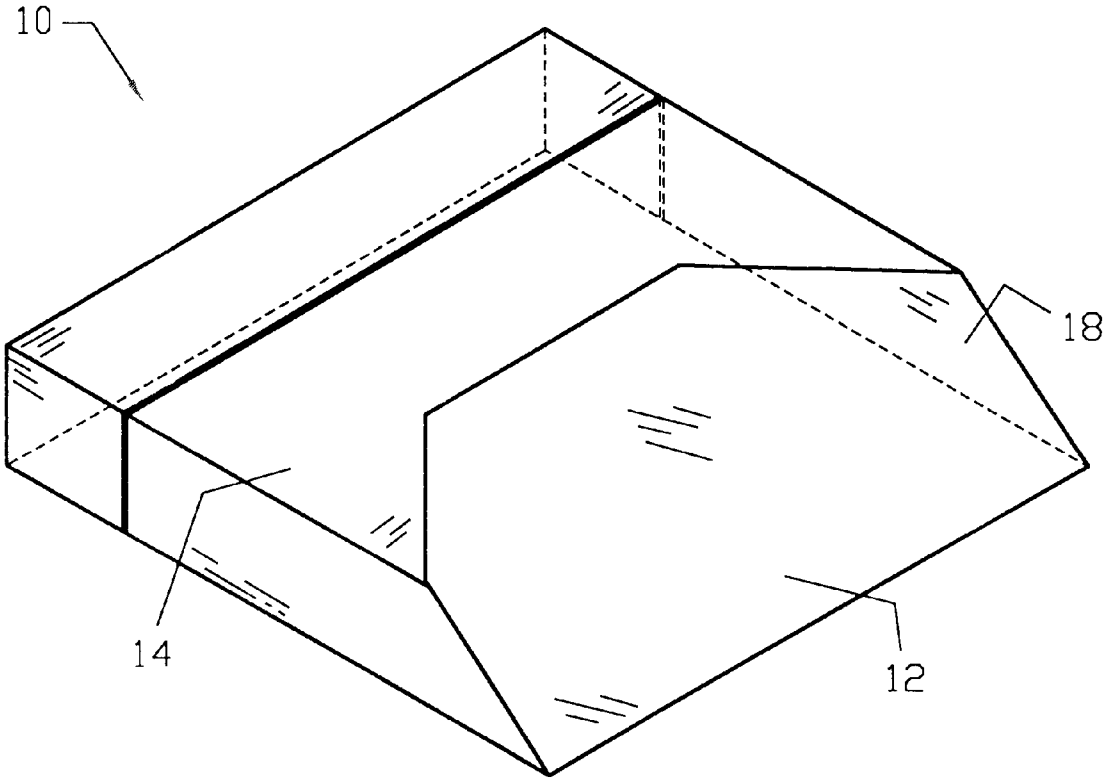
FIG. 1 is a perspective view of the foldable pan of the present invention.
Figure 2:
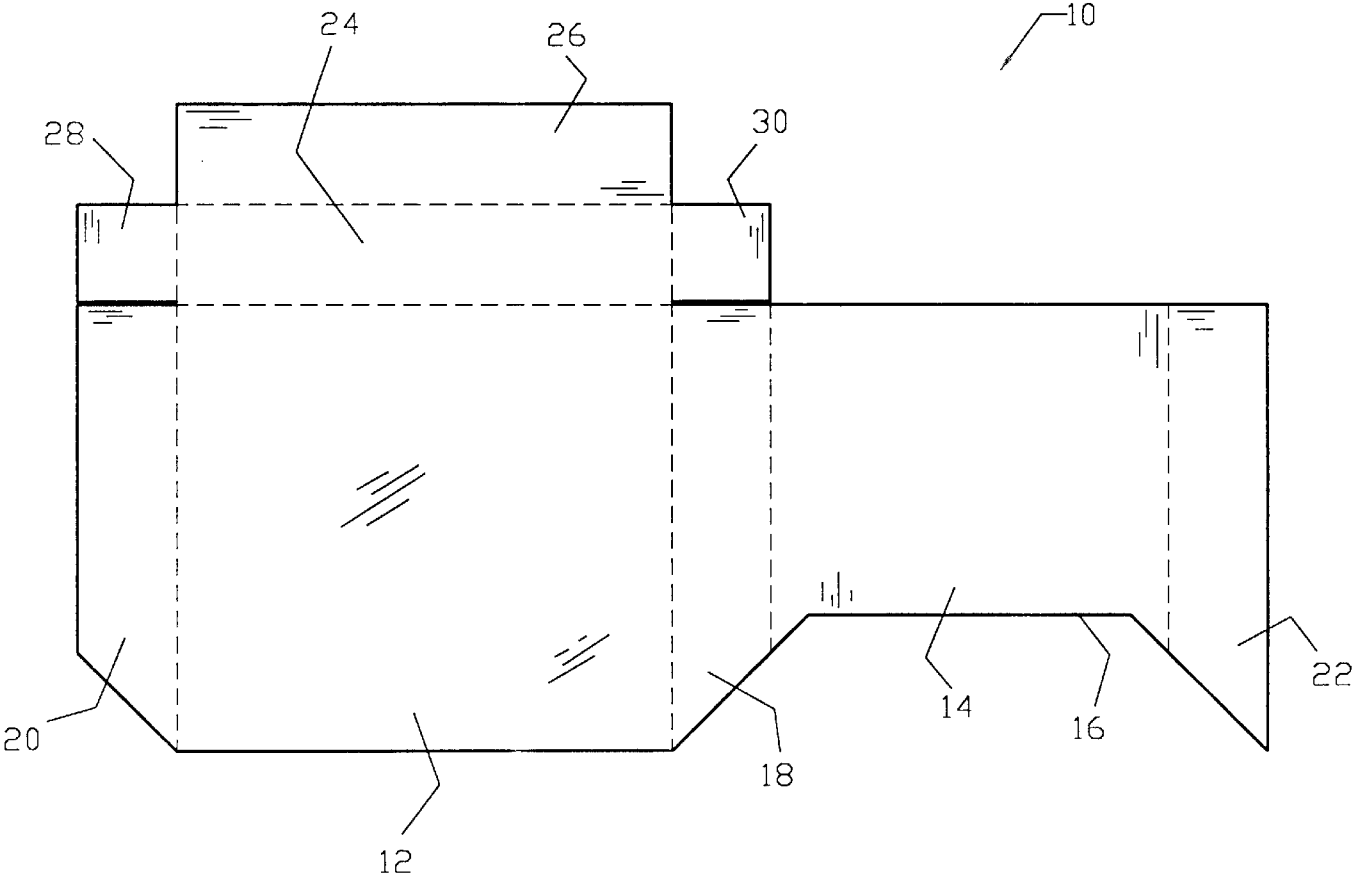
FIG. 2 is a plan view of the foldable pan.
Figure 3:
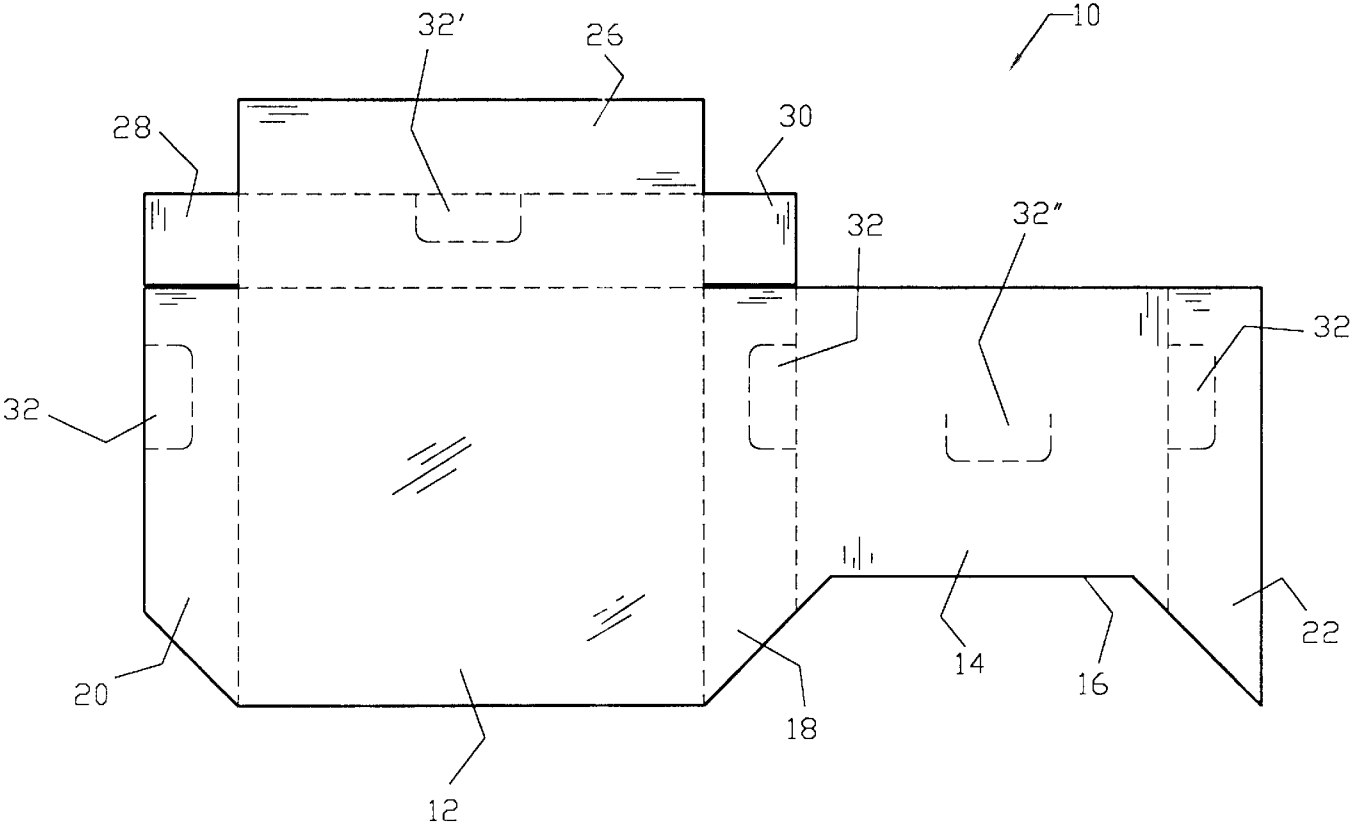
FIG. 3 is a plan view of the foldable pan utilizing perforated sections.
Figure 4:
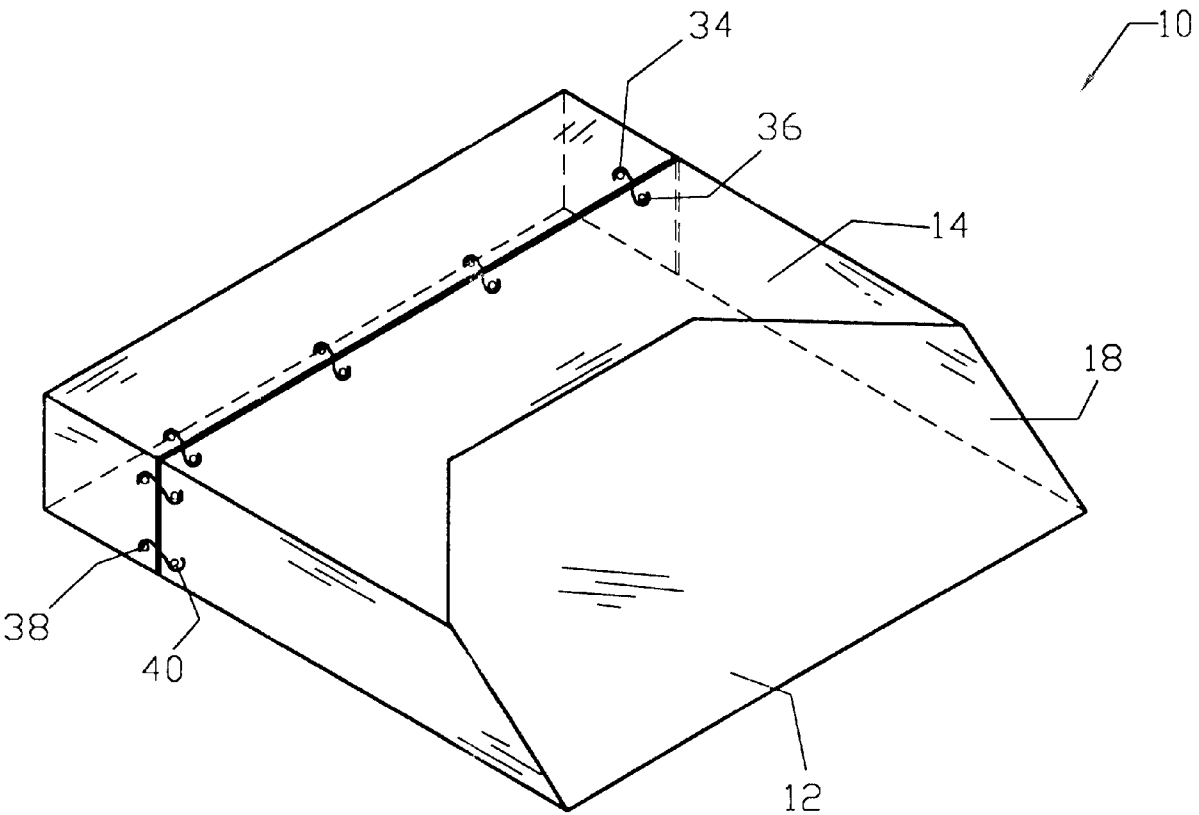
FIG. 4 is a perspective view of the foldable pan of the present invention utilizing a string and post connection method.
Figure 5:
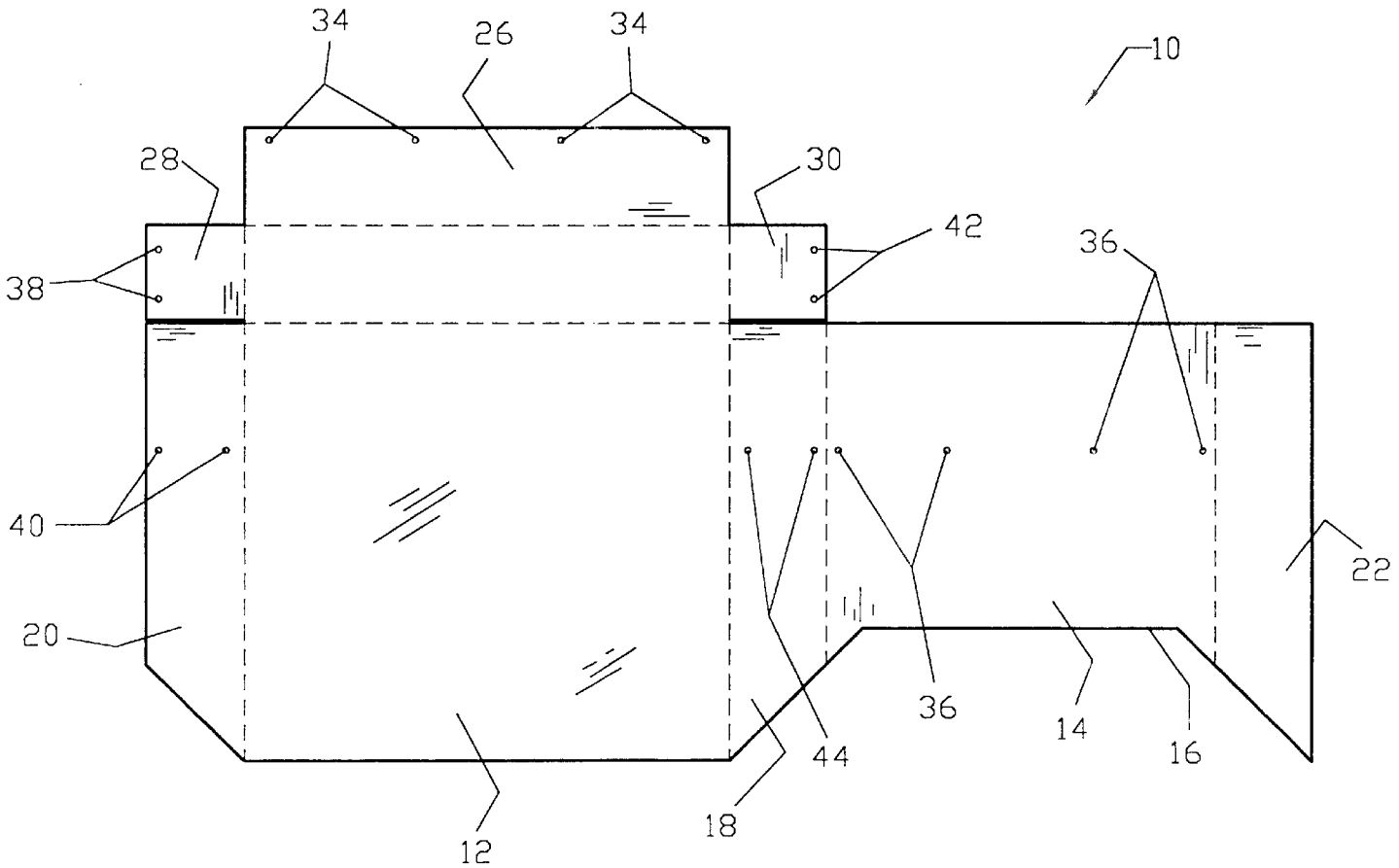
FIG. 5 is a plan view of the foldable pan utilizing the string and post connection method.
Figure 6:
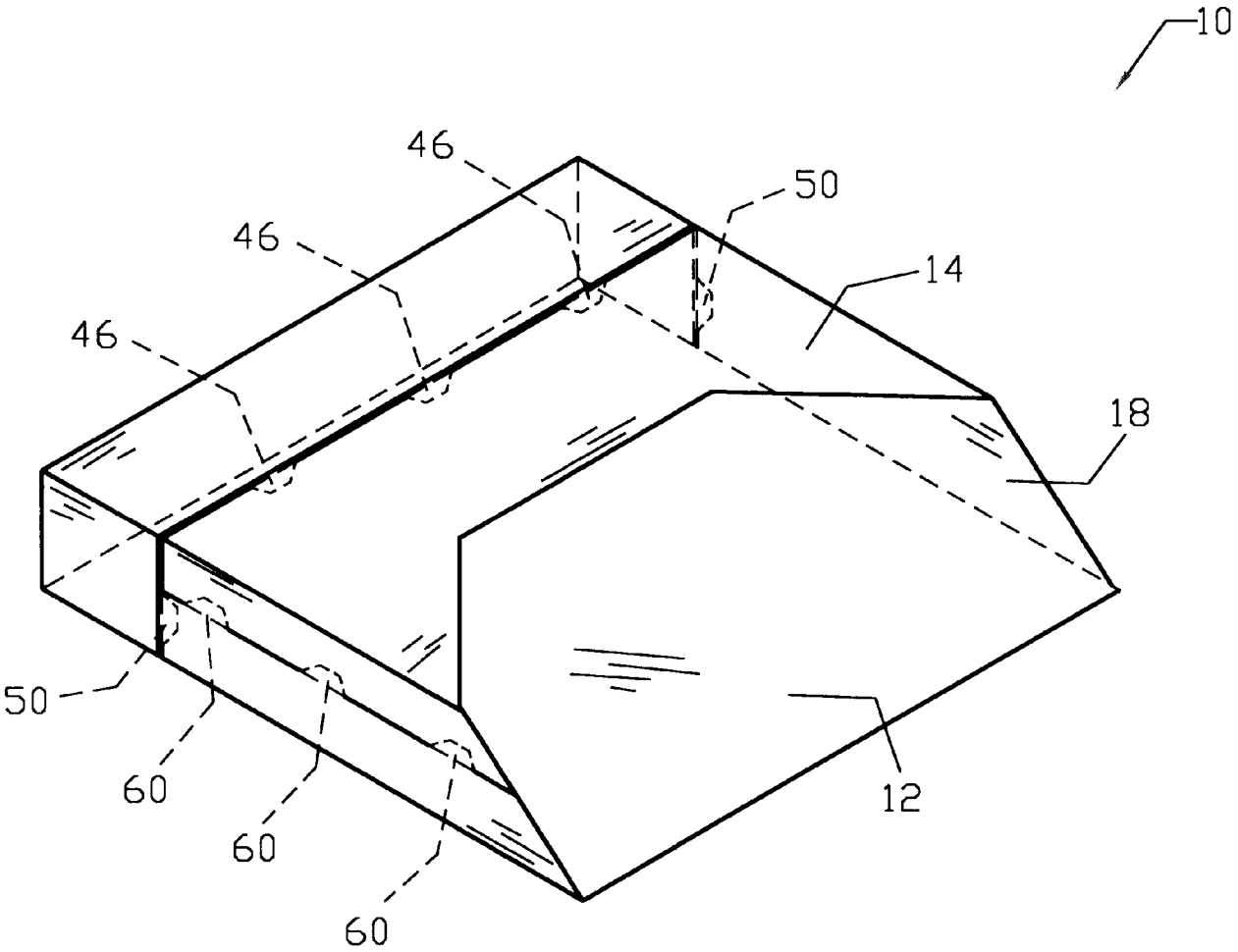
FIG. 6 is a perspective view of the foldable pan of the present invention utilizing a tongue and slit connection method.
Figure 7:
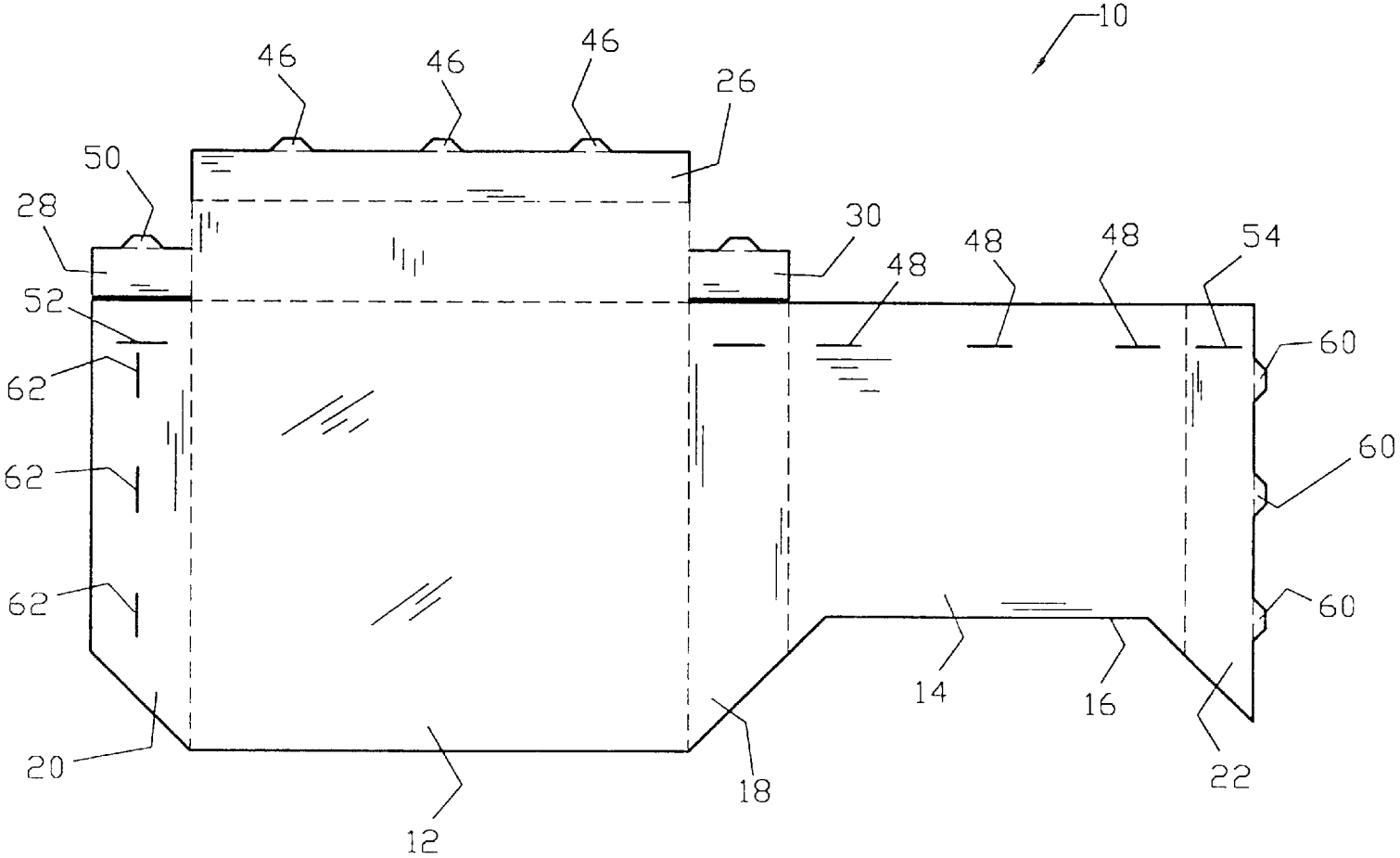
FIG. 7 is a plan view of the foldable pan utilizing the tongue and slit connection method.
Figure 8:
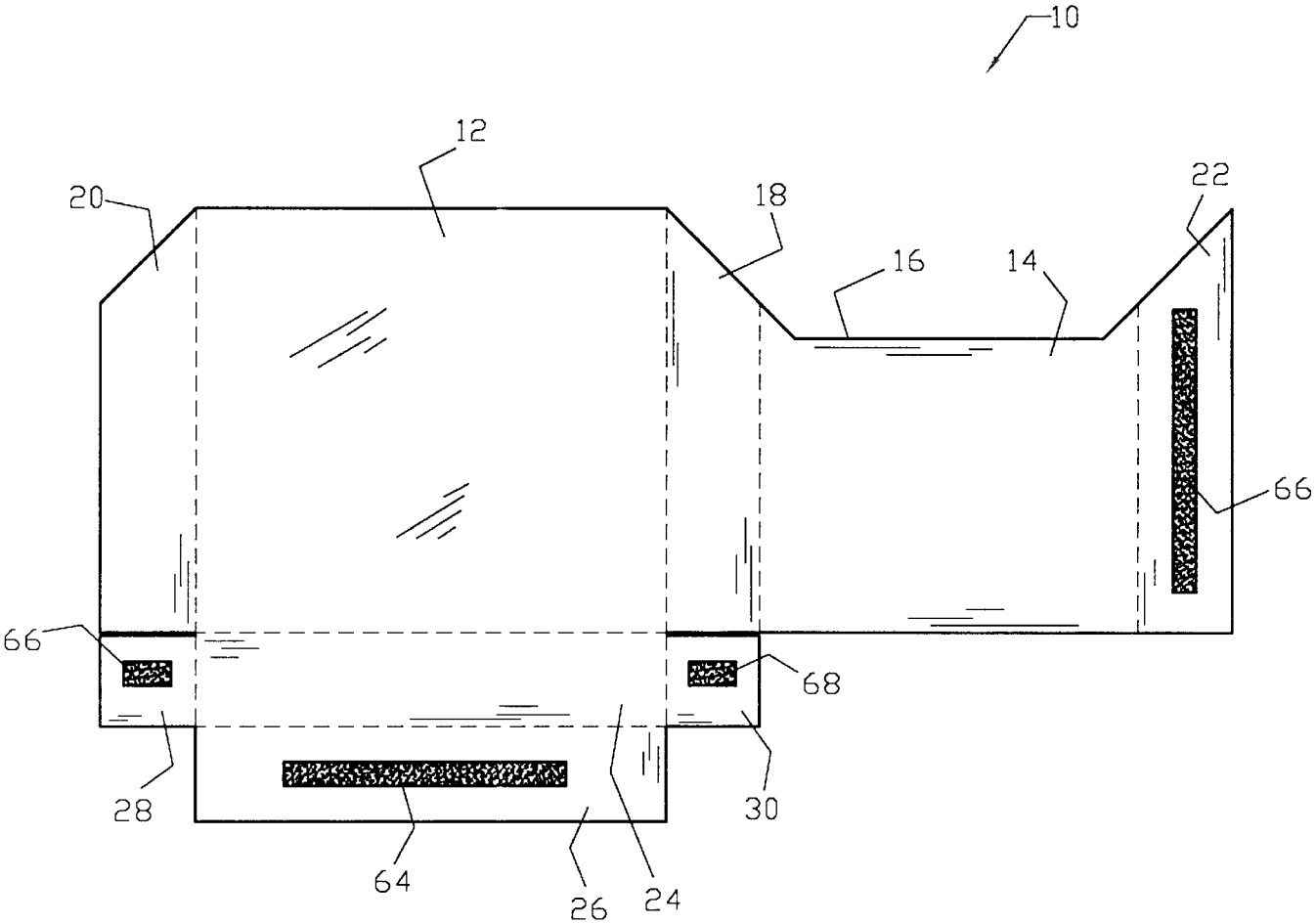
FIG. 8 is a plan view of the foldable pan utilizing the adhesive connection method.

Referring now to the drawings, it is seen that the foldable pan of the present invention, generally denoted by numeral 10, is comprised of a large unitary sheet member that can be made from an appropriate paper product such as heavy paper or cardboard, a plastic sheet product or other similar material. The sheet member has a first body member 12 that has a first length and a first width and a second body member 14 that has a second length that is substantially similar to the first length the and a second width that is less the first width. The second body member 14 has a notch 16 along its outer length. A first side member 18 is foldably attached to the first body member 12 and is foldably attached to the second body member 14, while a second side member 20 is foldably attached to the first body member 12, and a third side member 22 is foldably attached to the second body member 14. A connection member 24 is foldably attached to the first body member 12 and is foldably attached to a first flap 26. A second flap 28 is foldably attached to the connection member 24, and a third flap 30 is also foldably attached to the connection member 24. The foldable attachment of the respective members is accomplished by providing an appropriate fold line along the length of the foldable connection of the respective members to one another. Alternately, the foldable pan can be constructed such that each individual member is a separate member disjoint from other members, and the respective members are attached to one another by appropriate hinges (not illustrated)

In order to assemble the assemble the foldable pan 10 of the present invention, the second body member 14 is folded, via the first side member 18 (the first side member 18 being folded upwardly (or downwardly as the device 10 is symmetrical) with respect to the first body member 12, and the second body member 14 being folded outwardly with respect to the first side member 12), such that the second body member 14 is above and generally parallel with the first body member 12. The second side member 20 is folded upwardly, and the third side member 22 is folded downwardly such the second side member 20 and the third side member 22 overlap. As the length of the first body member 12 and the length second body member 14 are substantially equal, a good overlap of the second side member 20 and the third side member 22 will occur.

The first flap member 26 is folded, via the connection member 24, in order to overlap the second body member 14. The second flap member 28 is folded to overlap the second side member 20 and the third side member 22 and the third flap member 30 is folded to overlap the first side member 18. The first flap member 26 and the second body member 12 are appropriately joined to one another as are the second flap member 28, the second side member 20 and the third side member 22, and also the third flap member 28 and the first side member 18. Joining of the respective members can be accomplished in any appropriate fashion such as by stapling, gluing or taping the respective members to one another.

The foldable pan 10 is now ready for use. If desired, an appropriate handle (not illustrated) can be attached to the foldable pan 10 to assist in the debris pickup process. As the width of the second body member 14 is less than the width of the first body member 12 and as the second body member 14 is notched, it is easy to push debris into the interior of the assembled foldable pan 10. The foldable pan 10 may have one or more perforated sections such that the user pushes in on the perforated sections in order to create a carrying point for the foldable pan 10. Perforated sections 32 can be located on each of the first side member 18, the second side member 20, and the third side member 22. A perforated section 32' can be located on the connection member 24, and a perforated section 32" can be located on the second body member 14.

As an alternate method of attachment of the respective members to one another, an appropriate connection means can be provided on the foldable pan 10. The connection means can comprise at least one first string 34 attached to the first flap 26 and at least one first post 36 attached to the second body member 14 (or vice versa), at least one second string 38 attached to the second flap 28 and at least one second post 40 attached to one of the second side member 20 or the third side member 22 (or vice versa), and least one third string 42 attached to the third flap 30 and at least one third post 44 attached to the first side member 18 (or vice versa). When the respective members are in position to be joined, the respective string is tied around the respective post in order to provide effective joinder of the members.

Alternately, the connection means can comprise at least one first tongue 46 attached to the first flap 26 and at least one first slit 48 disposed on the second body member 14, at least one second tongue 50 attached to the second flap 28 at least one second slit 52 disposed on the second side member 20 and at least one third slit 54 disposed on the third side member 22, each of the third slits 54 corresponding with a respective one of the second slits 52 when the second side member 20 and the third side member 22 overlap, at least one third tongue 56 attached to the third flap 30 and at least one fourth slit 58 disposed on the first side member 18, and at least one fourth tongue 60 attached to the third side member 22 and at least one fifth slit 62 disposed on the second side member 20 (or vice versa). When the respective members are in position to be joined, the respective tongue is inserted into its corresponding slit or slits in order to provide effective joinder of the respective members.

As a further alternative, the connection means can comprise a first adhesive portion 60 disposed on one of the first flap 26 or the second body member 14, a second adhesive portion 62 disposed on at least one of the second flap 28, the second side member 20 or the third side member 22, and a third adhesive portion 64 disposed on one of the third flap 30 or the first side member 18. When the members to be joined overlap one another, they are pressed into one another so that the respective adhesive portion holds the members together. The adhesive can be of any desired type such as a pressure sensitive adhesive. Additionally, each adhesive portion can be covered with a standard protective peel strip (not illustrated), the peel strip being removed just prior to use.

While the invention has been particularly shown and described with reference to an embodiment thereof, it will be appreciated by those skilled in the art that various changes in form and detail may be made without departing from the spirit and scope of the invention.

I claim:

1. A foldable pan comprising:

a first body member having a first length and a first width;

a second body member having a second length and a second width;

a first side member foldably attached to the first body member and foldably attached to the second body member;

a second side member foldably attached to the first body member;

a third side member foldably attached to the second body member;

a first flap member;

a connection member foldably attached to the first body member and foldably attached to the first flap;

a second flap foldably attached to the connection member; and a third flap foldably attached to the connection member.

2. The foldable pan as in claim 1 wherein the second body member is notched.

3. The foldable pan as in claim 1 wherein the first length is substantially similar to the second length.

4. The foldable pan as in claim 1 wherein the first width is greater than the second width.

5. The foldable pan as in claim 1 wherein the first body member, the second body member, the first side member, the second side member, the third side member, the first flap, the connection member, the second flap, and the third flap are all constructed from a paper product.

6. The foldable pan as in claim 1 further comprising:

a first connection means for attaching the first flap to the second body member;

a second connection means for attaching the second flap to the second side member and to the third side member; and a third connection means for attaching the third flap to the first side member.

7. The foldable pan as in claim 6 wherein the first connection means comprises at least one first string attached to the first flap and at least one first post attached to the second body member, the second connection means comprises at least one second string attached to the second flap and at least one second post attached to one of the second side member or the third side member, and the third connection means comprises at least one third string attached to the third flap and at least one third post attached to the first side member.

8. The foldable pan as in claim 6 wherein the first connection means comprises at least one first string attached to the second body member and at least one first post attached to the first flap, the second connection means comprises at least one second string attached to one of the second side member or the third side member and at least one second post attached to the second flap, and the third connection means comprises at least one third string attached to the first side member and at least one third post attached to the third flap.

9. The foldable pan as in claim 6 wherein the first connection means comprises at least one first tongue attached to the first flap and at least one first slit disposed on the second body member, the second connection means comprises at least one second tongue attached to the second flap and at least one second slit disposed on the second side member and at least one third slit disposed on the third side member and at least one third tongue attached to the third side member and at least one fourth slit disposed on the second side member, and the third connection means comprises at least one fourth tongue attached to the third flap and at least one fifth slit disposed on the first side member.

10. The foldable pan as in claim 6 wherein the first connection means comprises a first adhesive portion disposed on the first flap, the second connection means comprises a second adhesive portion disposed on the second flap and a third adhesive portion disposed on one of the second side member or the third side member, and the third connection means comprises a fourth adhesive portion disposed on the third flap.

11. The foldable pan as in claim 6 wherein the first connection means comprises a first adhesive portion disposed on one of the first flap or the second body member, the second connection means comprises a second adhesive portion disposed on at least one of the second flap, the second side member or the third side member, and the third connection means comprises a third adhesive portion disposed on one of the third flap or the first side member.

12. The foldable pan as in claim 1 further comprising a connection means for attaching the first flap to the second body member, attaching the second flap to the first side member and attaching the third flap to the second side member.

13. The foldable pan as in claim 12 wherein the connection means comprises at least one first string attached to the first flap and at least one first post attached to the second body member, at least one second string attached to the second flap and at least one second post attached to one of the second side member or the third side member, and least one third string attached to the third flap and at least one third post attached to the first side member.

14. The foldable pan as in claim 12 wherein the connection means comprises at least one first string attached to the second body member and at least one first post attached to the first flap, at least one second string attached to one of the second side member or the third side member and at least one second post attached to the second flap, and at least one third string attached to the first side member and at least one third post attached to the third flap.

15. The foldable pan as in claim 12 wherein the connection means comprises at least one first tongue attached to the first flap and at least one first slit disposed on the second body member, at least one second tongue attached to the second flap, at least one second slit disposed on the second side member and at least one third slit disposed on the third side member, at least one third tongue attached to the third side member and at least one fourth slit disposed on the second side member, and at least one fourth tongue attached to the third flap and at least one fifth slit disposed on the first side member.

16. The foldable pan as in claim 12 wherein the connection means comprises a first adhesive portion disposed on the first flap, a second adhesive portion disposed on the second flap, and a third adhesive portion disposed on the third flap.

17. The foldable pan as in claim 12 wherein the connection means comprises a first adhesive portion disposed on one of the first flap or the second body member, a second adhesive portion disposed on at least one of the second flap, the second side member or the third side member, and a third adhesive portion disposed on one of the third flap or the first side member.

18. The foldable pan as in claim 1 further comprising:

a first perforated section disposed on the first side member;

a second perforated section disposed on the second side member; and a third perforated section disposed on the third side member.

19. The foldable pan as in claim 1 further comprising a perforated section disposed on the connection member.

20. The foldable pan as in claim 1 further comprising a perforated section disposed on the second body member.

* * * * *